US005775053A

United States Patent [19]

Lam

[11] Patent Number: 5,775,053

[45] Date of Patent: Jul. 7, 1998

[54] CASE SEALING SYSTEM

[75] Inventor: Joe Augustine Shing-Tak Lam, Richmond, Canada

[73] Assignee: Belcor Industries Inc., Richmond, Canada

[21] Appl. No.: 852,208

[22] Filed: May 6, 1997

Related U.S. Application Data

[62] Division of Ser. No. 654,497, May 28, 1996, Pat. No. 5,687,543.

[51] Int. Cl.[6] ..... B65B 61/00

[52] U.S. Cl. ..... 53/136.4; 53/504; 53/376.5; 53/377.4; 53/201

[58] Field of Search ..... 53/284.3, 504, 53/376.3, 376.5, 377.4, 377.2, 136.4, 491, 201; 493/117, 382, 476; 148/836.3

[56] References Cited

U.S. PATENT DOCUMENTS

| | | | |
|---|---|---|---|
| 4,044,527 | 8/1977 | Ulrich et al. | 53/136.4 |
| 4,161,138 | 7/1979 | Marchetti | 53/136.4 |
| 4,541,888 | 9/1985 | Marchetti | 53/136.4 |
| 4,658,563 | 4/1987 | Lissoni | 53/136.4 |

*Primary Examiner*—James F. Coan
*Assistant Examiner*—Gene L. Kim
*Attorney, Agent, or Firm*—C. A. Rowley

[57] ABSTRACT

A case sealing system utilizes a parallel link mechanism with a built-in locking positioning system to support a case sealer such as a taper, gluer or stapler or the like at a selected height above a support table whereby the height of the sealer above the table may be readily adjusted to accommodate different height packages. Preferably, the system will also include a pair of easily adjusted side guides that are moveable to positions to center different width packages relative to the centre line of the sealer so that the equipment may be quickly and accurately be positioned to accommodate different sized packages.

6 Claims, 8 Drawing Sheets

CASE SEALING SYSTEM

This application is a division of application Ser. No. 08/654,497, filed May 28, 1996 now U.S. Pat. No. 5,687, 543.

FIELD OF INVENTION

The present invention relates to a packaging machine, more particularly, the present invention relates to an adjustable case sealer system.

BACKGROUND OF THE INVENTION

Devices for applying an adhesive sealing tape, staples or glue or the like to close the top and/or bottom of a carton such as a corrugated carton are very well known. Many different models are in commercial operation. Generally, these case sealers are either manual, automatic or semiautomatically adjustable to accommodate different sized cartons as in most packaging operations, the size of the carton used changes significantly depending on what is packaged. A semiautomatic case sealing system sold under the trademark DURABLE do it all series RM32A/RM22A by Durable Packaging Corp. is a semiautomatic case sealer with side drives to automatically advance carton under a taping head, the height of which is manually adjustable via a screw and hand crank adjusting the position of a slide along a vertical shaft. The side belts are powered to automatically move the carton therethrough and tape is applied to both top and bottom.

The 3M company sell a full line of case sealers known as 3M Matic Case Sealers. In some of these devices, the top sealing or taper is mounted cantilever fashion on a vertical post but in most, a pair of post are positioned one on each side of the unit and guide a transverse support beam for vertical movement to adjust the height of the taper. In these systems manual adjustment, generally by a hand wheel or hand crank is used to adjust the height of the taper by moving the support beam up and down relative to the two support post.

It is also known to support the taper from a transverse beam and adjust the taper height by a screw thread or the like.

It will be apparent that in any of these devices, adjustment of the tape applicator height requires a number of different movements such as determining the required position the head, turning the hand wheel to move the head to the required position for different sizes of boxes or automatic adjustment based on sensing the dimension of the box. All these conventional system take a significant amount of time which negatively impacts on production rate.

The system must also make adjustments to accommodate different width cartons by repositioning lateral guide whether they are belt drives or simply guides. In the known systems, this generally requires loosening of a locking element (generally a threaded element) adjusting the position of the lateral guides and then locking the unit. In some cases, both side guides are moved simultaneously to maintain their uniform spacing at opposite sides of the center of the machine. In other cases, each side must be adjusted individually.

BRIEF DESCRIPTION OF THE PRESENT INVENTION

It is an object of the present invention to provide a simple yet effective mechanism for adjusting the height of a sealing element on a case sealer or the like.

It is a further object of the present invention to provide a simple system of easy adjustment of lateral guide bars for centering a package relative to the sealer.

Broadly, the present invention relates to a packaging machine comprising a frame, a support surface on said frame, an arm means mounted on said frame to one side of said support surface, said arm means being a parallel link mechanism composed with a pair of parallel arms, a first pair of spaced parallel pivotal connections one mounting each said arm adjacent to one end of its said arm to said frame to pivot on its pivotal axis, a support frame, a second pair of spaced pivotal connections one for each said arm to pivotably connect its said arm to said support frame, said second pair of pivotal connections each being positioned adjacent to an end of its arm remote from said first pair of pivotal connections, said pivotal connections of said first and second pair permitting rotation about substantially parallel axes, locking positioning means interconnecting said pair of arms to releasably lock said arms in selected positions, a support beam extending from said support frame in a direction to project over said surface, and a package closing means mounted over said surface on said support beam and control means for controlling said locking positioning means.

Preferably, said control means for said locking position means is positioned adjacent to an inlet end of said package closing means.

Preferably, said package closing means is a taper.

Preferably, a second taper projects through said surface in a position opposite said taper to close a side of said package opposite to a side of such package to be closed by said taper.

Preferably, said packaging mechanism further comprises a pair of lateral guide means positioned one on each side of a centerline of a path of travel of a package through said packaging mechanism and equally spaced on said opposite sides of said centerline and between which a package to be processed by said mechanism is to be guided, a support arm connected to each of said guides, a mounting plate, a pair of shaft means one mounting each of said support arms for rotational movement on rotational axes, said shaft of said pair of shaft means mounted on said mounting plate in spaced parallel relationship with said rotational axes in spaced parallel relationship to permit said support arms to rotate said support plate being mounted on a frame of said mechanism to position said rotational axes symmetrically one on each side of said centerline, a connector means interconnecting said shafts for rotation in equal but opposite relative directions and releasable means for locking said connector means in a selected position to thereby lock said guide means in positions symmetrical relative to said centerline.

Preferably, said connector means comprise sprockets on each of said shafts, a chain means wrapping said sprockets in a figure eight configuration and said releasable means interconnecting opposite ends of said chain to complete said figure eight configuration.

Preferably, hinge means pivotably mount said plate on said frame for movement on an axis substantially perpendicular to said longitudinal axis to move said guides between a guiding and an adjustment position, means to release said releasable means when said guides are in said adjustment position to permit movement of said chain means.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
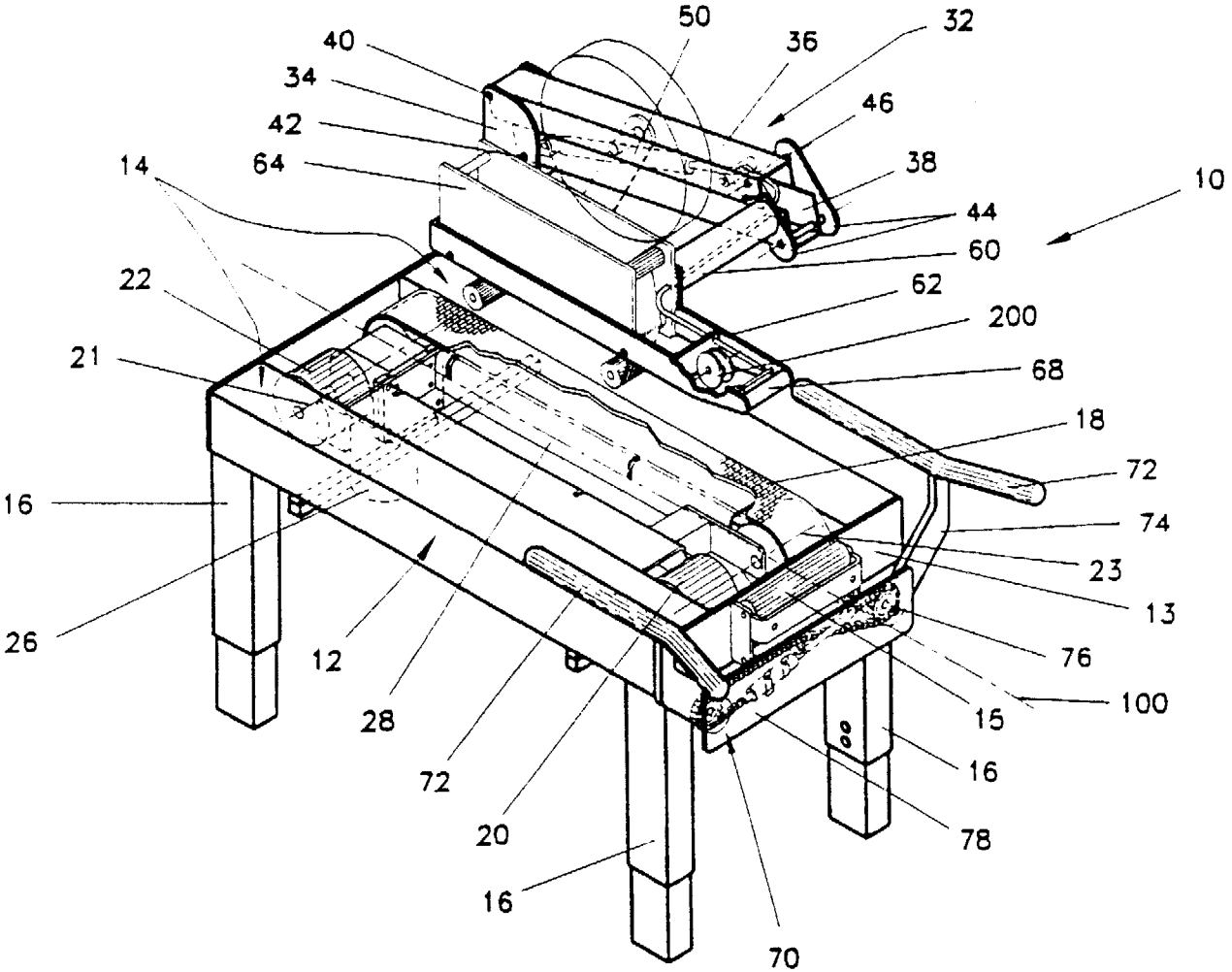
FIG. 1 is a isometric view of a sealer system (the parts removed) constructed in accordance with the present invention.

As shown in FIG. 1, the sealer 10 of the present invention include a table formed by a frame 12 having an upper package support surface 14 supported at each corner on adjustable legs 16.

The inlet end 13 of the frame has a suitable guide roller 15 mounted in position to facilitate introduction of cartons or the like into the machine and onto the belts 18.

The support surface 14 has a pair of parallel driven belts 18 (only one shown) each supported on a pair of rolls 20 and 22 and on a slide support 24 which maintains the upper run of the belts 18 just above the fixed portion of the surface 14. The rolls 20 and 22 each rotate about on an axis 21 and 23 respectively perpendicular to the pair of parallel belts 18.

The rolls 22 are preferably driven by a suitable motor 26 to move the cartons or packages along the upper support surface 14 from an inlet side 13 to an outlet side and along a centerline 100 of the path of travel of the packages over the surface 14.

In the illustrated arrangement, a suitable housing 28 is provided between the belts 18 and is adapted to receive a sealing mechanism such as an adhesive applicator, a tape applicator or stapler 30 (see FIG. 2) or the like.

A parallel link support arm 32 is mounted on a vertical post 34 projecting up from the frame 12. The arm 32 is formed by a pair of parallel link arm 36 and 38 which are pivotably mounted on the post 34 by a shaft 40 extending through the arm 36, and substantially parallel to the surface 14 and by shaft 42 substantially parallel to and horizontally offset from the shaft 40 extending through the adjacent end of the second arm 38. Thus, the adjacent ends of the arms 36 and 38 are pivotably connected to the post 34 via shafts 40 and 42 respectively to form one end of a parallel link mechanism of the arm 32.

The other ends of the arms 36 and 38 are pivotably interconnected to a support frame 44 via shaft 46 and 48 respectively to complete the parallel mechanism of arm 32.

Figure 3:
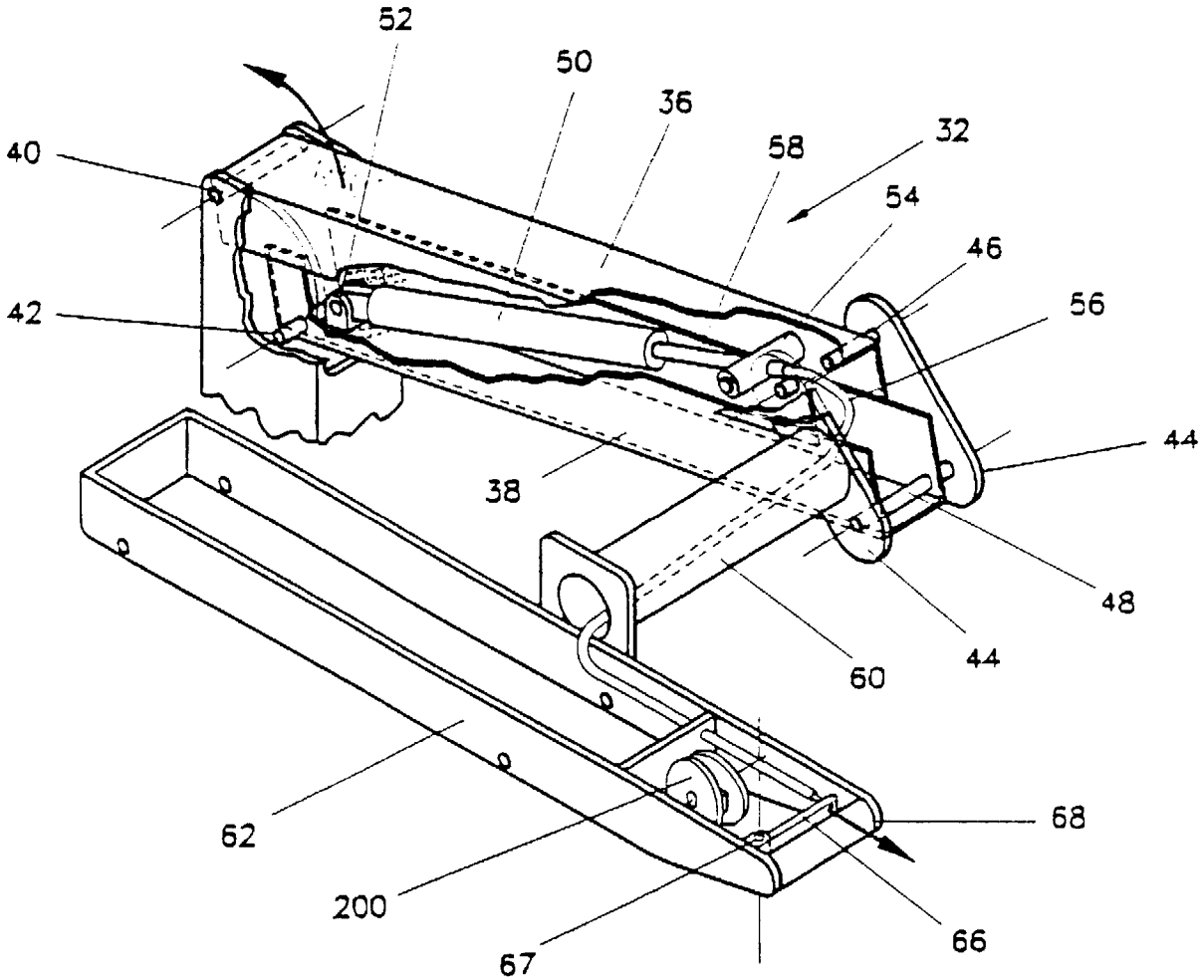
FIG. 3 shows the parallel link and the positioning of its release control on the inlet end of the taper.

In FIG. 3, a locking position mechanism 50 has been shown as an extendible locking positioning mechanism 50 which is connected at one end to the arm 38 via pivotal connection 52 and at its other end to the arm 36 by pivotal connection 54.

A preferred type of device 50 is a double acting hydraulic cylinder pneumatically biased to an extended position wherein a valve operated by a suitable control permits flow of hydraulic fluid between opposite sides of the piston and wherein the pneumatic pressure provides a biasing force to balance the weight of the arm and accommodate for the different available cross-sectional area of the cylinder on opposite sides of the piston, for example BLOC-O-LIFT sold by Stabilus.

Figure 2:
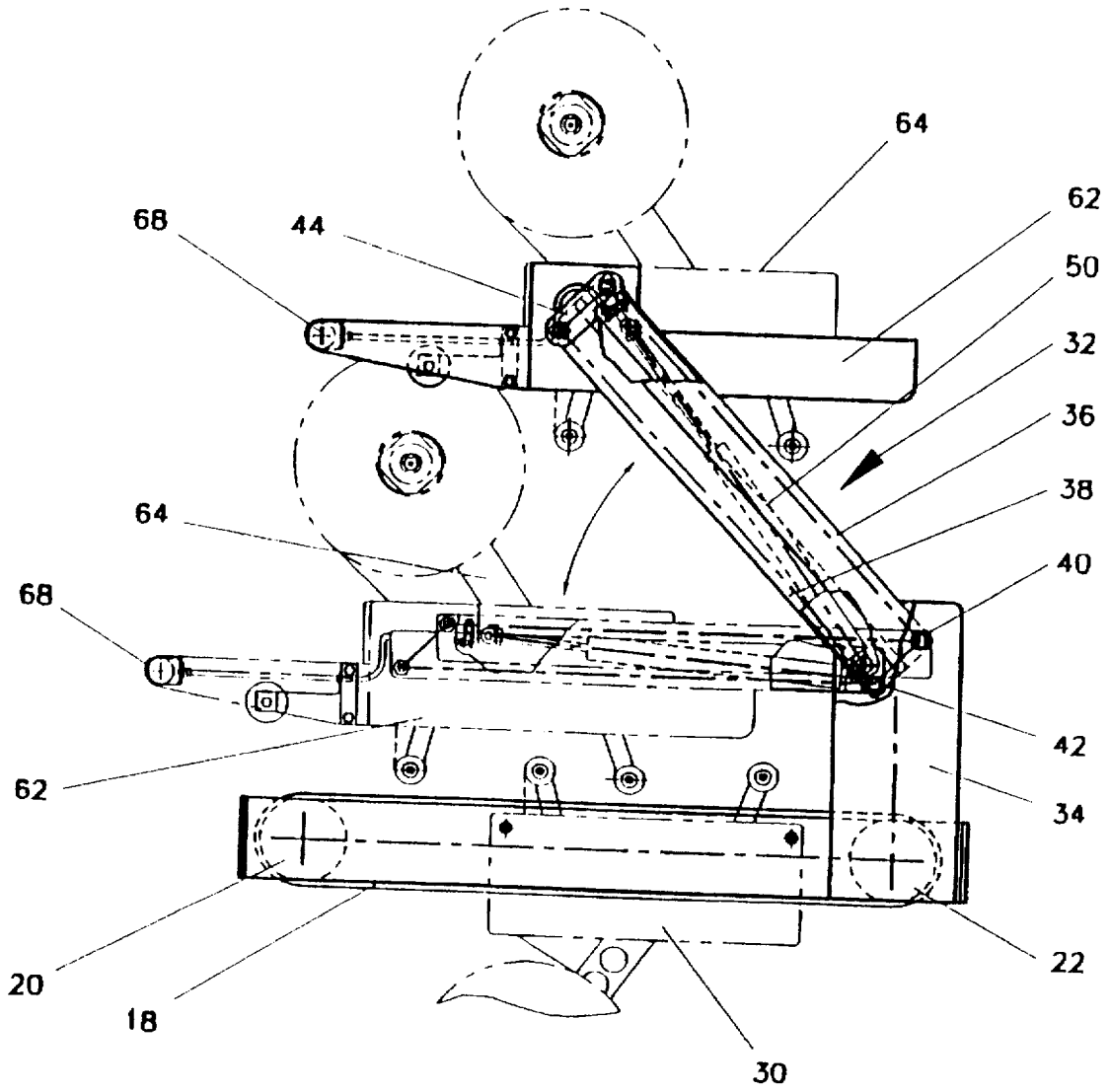
FIG. 2 is a side view of a sealer constructed in accordance with the present invention showing the scope or height of adjustment of the sealer relative to the package support surface.

A suitable control cable or the like 56 extends through and from a shaft 58 of the extendible mechanism 50 through a support beam 60 fixed at one end to the frame 44 at its opposite end to a support housing 62 to hold suitable sealing mechanism such as the tape applicator 64 shown in FIG. 2 and is connected to a trigger or operating arm 66 mounted adjacent to the inlet end 68 of the housing 62 to position the manipulating switch 66 in easy grasp of an operator positioned on either side of the machine. The trigger 66 is preferably pivotal to the housing 62 on a pivot pin 67 substantially perpendicular to the surface 14.

If the systems is to be automated, the locking positioning means 50 will preferably be a linear actuator such as a motor driven screw or a hydraulic actuator which will be controlled in the conventional manner by sensing the height of the package to be sealed using sensors preferably mounted at the inlet end of the housing 62.

As shown, most clearly in FIG. 3, the support beam 60 provides the sole means of support for the housing 62 and manipulation of the arm 32 by pivoting the shaft.

It will be apparent that the parallel link mechanism 32 maintains the angular position of the housing 62 so that it maintains the sealer 64 at the required orientation (essentially parallel) relative to the upper surface 14 of the frame 12 as the housing 62 is moved between its uppermost position shown in solid lines in FIG. 2 to its lowest position shown in dot-dash lines in FIG. 2.

As previously indicated, it is also important to guide the sides of the carton to be sealed and ensure that the center of the box or carton is aligned with the centerline 100 of the path of travel through the machine and with the housings 28 and 62 so that the tape, assuming a taper is being used, is applied along the centerline of the box. If it is desired not to run the seal along the centerline of the box, the guiding means must be changed to accommodate.

Figure 4:
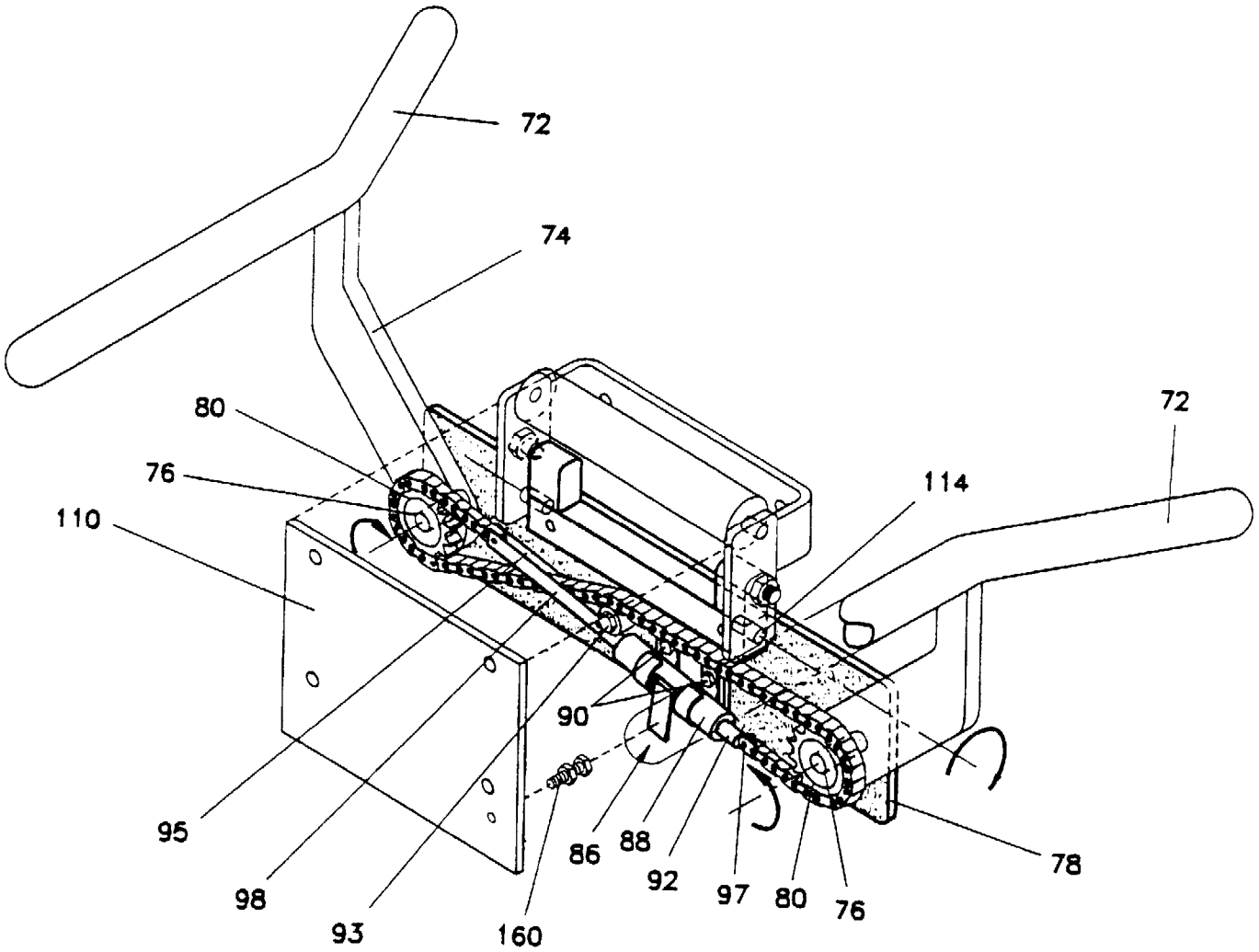
FIG. 4 is a partial exploded view showing the positioning mechanism for the guiding system of the present invention.
Figure 5:
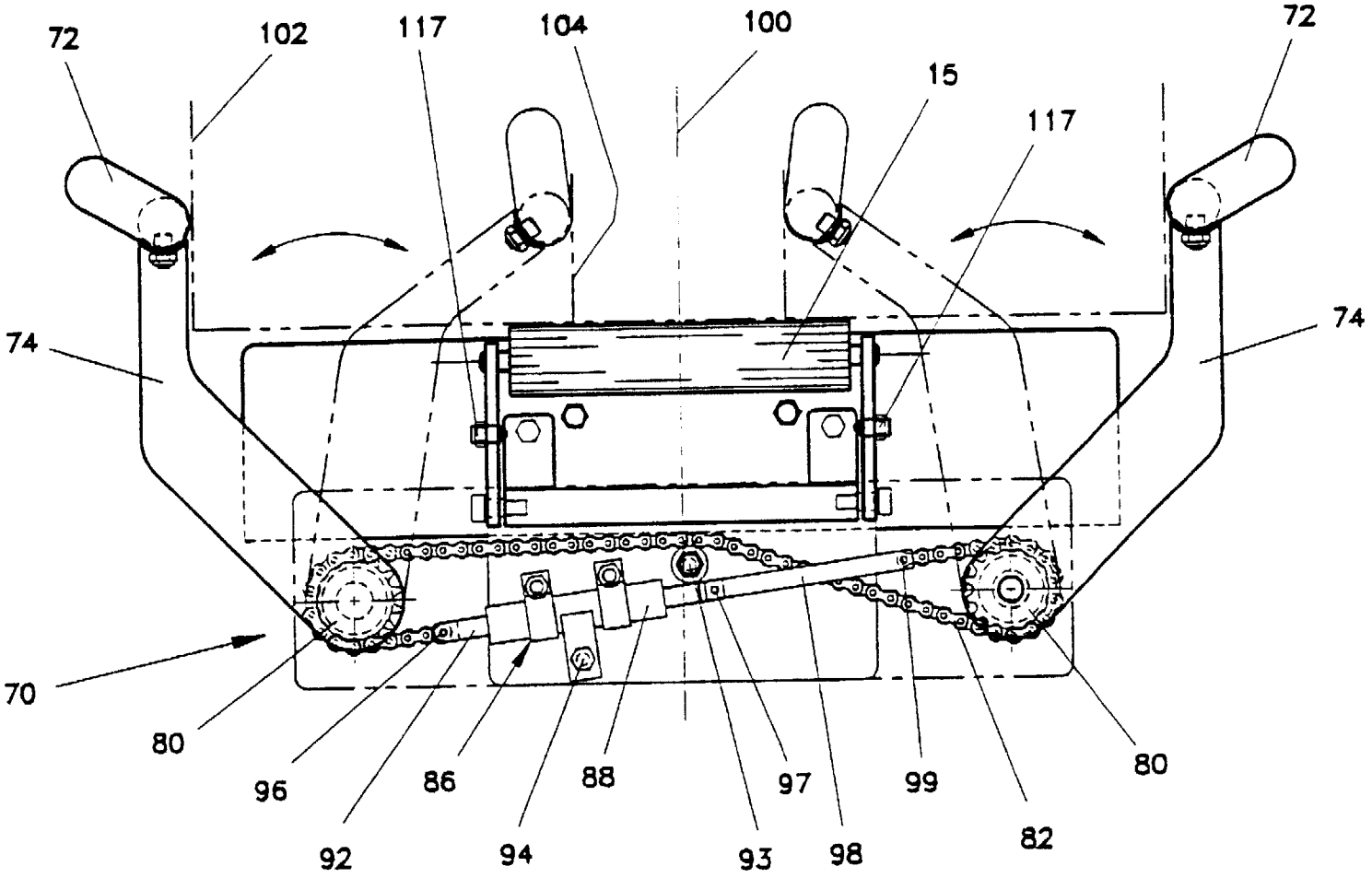
FIG. 5 is an end view looking in the direction of movement of packages into the equipment showing the scope of movement of the lateral guides relative to the support surface.

Referring back to FIG. 1, at the inlet end 13 of the machine is mounted a guiding mechanism 70 which is symmetrical on opposite sides of the longitudinal centerline 100 of the machine and is formed with a pair of guides 72, one on each side of the machine, each mounted on a support arm 74 which is fixed to a shaft 76 which in turn is mounted from a support plate 78 (see FIGS. 4 and 5). Each arm 74 is provided with a sprocket 80 which meshes with chain 82 so that movement or rotation of one of the sprockets 80 causes the other or second sprocket 80 to rotate to the same amount but in the opposite direction thereby to adjust to the position of the guides 72 in opposite directions by the same amount toward or away from the axial centerline 100 of the machine so that the two guides 72 are positioned the same distance from the centerline 100 thereby to align the packages such as schematically represented by the carton 102 or layer the carton schematically represented at 104 to be centered on the centerline 100 which, as above described, is aligned with the centerline of the housings 28 and 62.

To fix the guides 72 in the desired location, a releasable sliding connecting mechanism 86 is used. This mechanism 86 preferably is former by an outer housing 88 and a shaft 92 slidable through the housing 88 and lockable relative to the housing 88 (i.e. to hold the housing 88 and shaft 92 in relatively fixed position or released to permit relative axial sliding movement of the shaft 92 in the housing 88) by manipulating a release arm 94. The housing 88 is fixed to the plate 78 for movement therewith by suitable bolt 90 or the like One example of a suitable device 86 for this purpose is sold under the trademark or trade name MECHLOKS by P. L. Porter Co.

To complete this mechanism, one end of the chain 82 is connected as indicated at 96 to one end of the shaft 92 and an extension 98 is pivotably connected as indicated at 97 to the opposite end of the shaft 92 and at its opposite end to the chain 82 via pivotal connection 99. The extension 98 is formed, as illustrated in FIG. 4, with a passage 95 to permit passage of the chain 82 therethrough so that the chain 82 may remain in the same plane. Chain 82 as guided for movement through the passage 95 (as seen in FIG. 4) formed in the link 98 via a suitable guide wheel 93 mounted on a plate 78.

To facilitate release of the guiding mechanism 70, plate 110 is mounted on the front or inlet end 13 of the frame 12 below the inlet roller 15 and projects downwardly therefrom.

Figure 6:
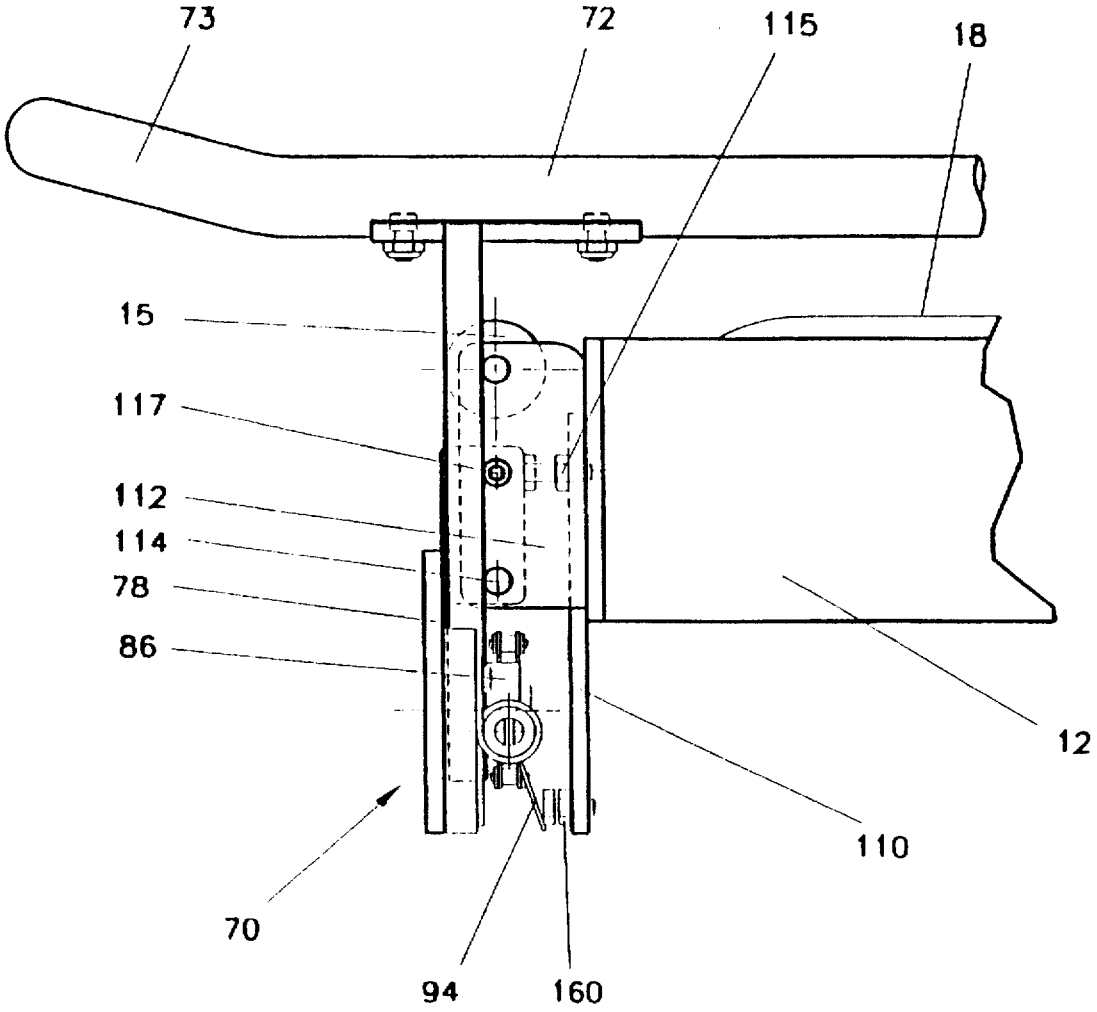
FIG. 6 shows the guiding mechanism in locked position with the guides in guiding position.
Figure 7:
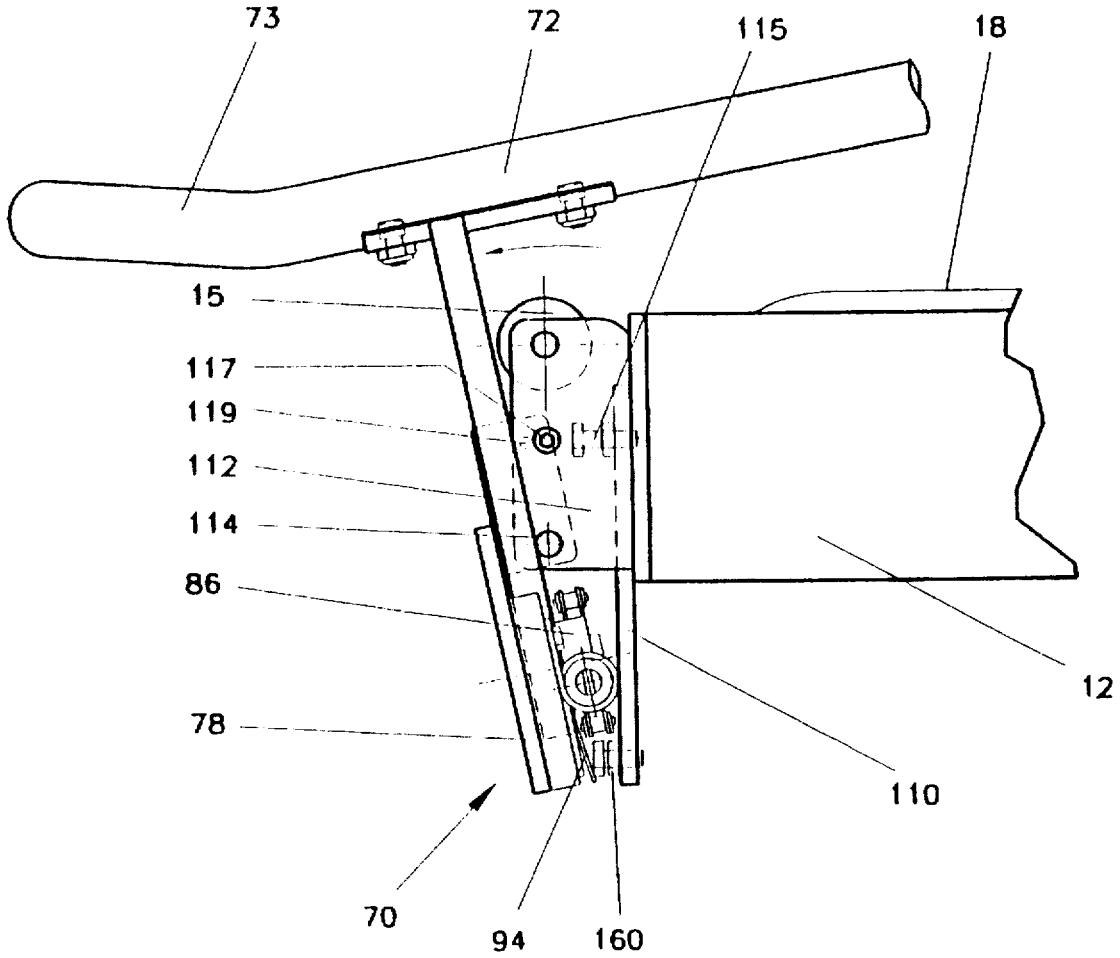
FIG. 7 shows the guides in unlocked position whereby their position relative to the centerline of the path of movement of packages over the support surface may be adjusted.
Figure 8:
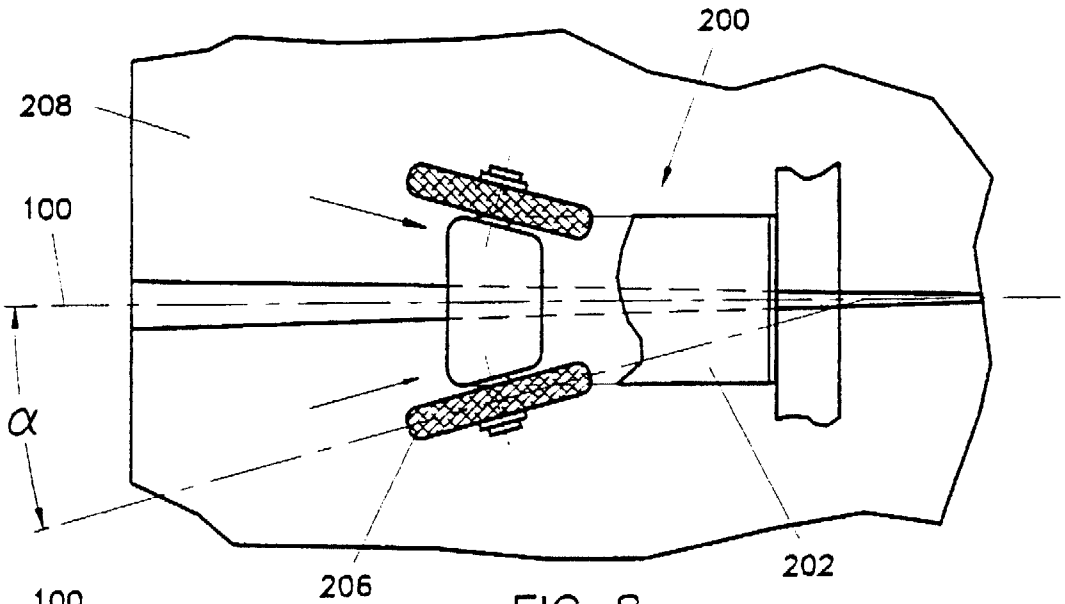
FIG. 8 is a plan view of the closing rollers in operating position.
Figure 9:
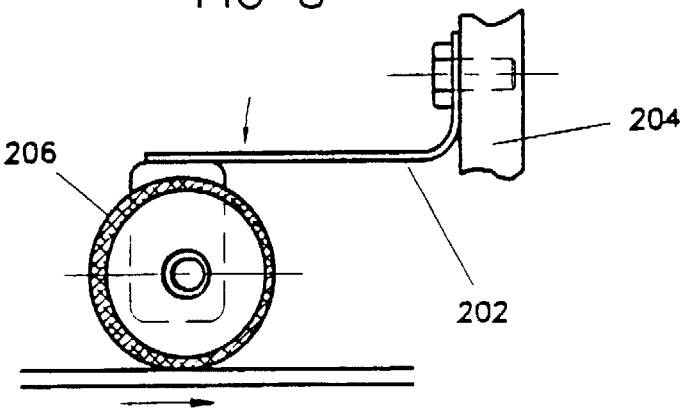
FIG. 9 is a side elevation showing the spring mounting of the closing rollers.

The plate 78 is hinged or mounted to the frame 112 supporting the roller 15 via a shaft or the like 114 for a pivotal movement between the position shown in FIGS. 6 and 7.

The position shown in FIG. 6, the plates 78 is substantially vertical and the guides 72 substantially horizontal and the spring detente(s) 117 (only one shown in FIGS. 6 and 7) mounted on frame 112 cooperates with the receiving depression 119 (fee FIG. 7) in the mounting flange for the plate 78 tend to hold the mechanism 70 against the stop 115 with the clutch or the like, manipulated by the arm 94 in locked position. When the mechanism 70 is pivoted to the position shown in FIG. 7, for example, by gripping the flared leading end 73 of the guide 72, the lever arm 94 is moved from the position shown in FIG. 6 to the position shown in FIG. 7 which releases the clutch or the like which may be formed, for example, by a spring wrapping the shaft 92, which is unraveled or unwound to a degree by movement of the arm 94 relative to the housing 88 to release the shaft 92 and permit it to move axially through the housing 86.

The degree of deflection of the lever 94 may be adjusted by changing the position of the stop 160.

Figure 10:
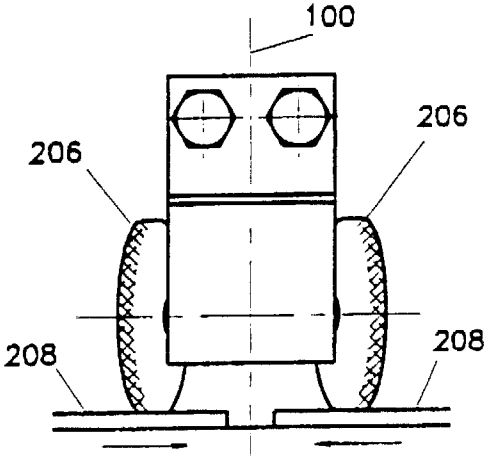
FIG. 10 is a view illustrating the closing action of the closing rollers.

If desired, at the leading or inlet end 68 of the housing 62, a pair of closing rollers 200 may be provided as shown in FIGS. 1, 3, 8, 9 and 10. These rollers 200 are resiliently mounted via a spring 202 from a wall 204 of the housing inlet end 68 (see FIG. 3) as indicated in FIG. 10, sloped at an angle to the direction of movement of the carton through the system, i.e. at an acute angle a to the longitudinal axis 100 of the machine. It will be apparent that these wheels 200 are providing the resilient friction surface 206 which aids in tending to force the flaps 208 (see FIG. 9) of the carton toward the centerline 100 thereby ensure that the box is properly close.

The operation of the device is relatively simple in that it is merely necessary for the operator to grasp the front end 68 of the housing 62, move the lever 66 to release the releasable mechanism 50, move the arm 32 to a raise position at the same time with the other hand, to pull forward on the guide 72 preferably by the handle 73 to release mechanism 86 and permit the arms 74 to pivot, i.e. the mechanism 70 is in the position illustrated in FIG. 6, the box to be closed is started into the machine and placed under the leading end 68 of the housing 62, the trigger or the like 66 is again released and the housing moved down into proper position relative to the top of the box. At the same time, the arms or guides 72 may be moved into these to engage with the side of the box to axially lined the box with the centerline 100 and then the mechanism 70 is tilted to its locked position to lock the arms, their proper guiding position for the carton to be taped.

Having described the invention, modifications will be evident to those skilled in the art without departing from the scope of the invention as defined in the appended claims.

I claim:

1. A packaging mechanism comprising a frame, a pair of lateral guide means positioned one on each side of a centerline of a path of travel of a package through said packaging mechanism and equally spaced on said opposite sides of said centerline and between which a package to be processed by said mechanism is to be guided, a support arm connected to each of said lateral guide means, a mounting plate, means mounting said mounting plate on said frame for movement relative to said frame between a locked position and a released position, a pair of shaft means one mounting each of said support arms, said pair of shaft means mounted on said mounting plate in spaced parallel relationship for rotation on a pair of spaced parallel rotational axes, said means mounting said mounting plate on said frame to position said rotational axes symmetrically one on each side of and in planes substantially parallel to said centerline, a connector means interconnecting said shafts for rotation in equal but opposite relative directions and releasable locking means for locking said connector means in a selected position to thereby lock each of said guide means in guiding positions spaced symmetrically on opposite sides of said centerline when said releasable locking means is in a locked position and permitting movement of said connector when said releasable locking means is in a released position, actuating means for placing said releasable locking means in said locked position when said plate is moved relative to said frame into said locking position and for placing said releasable locking means in said released position when said plate is moved relative to said frame into said released position.

2. A packaging machine as defined in claim 1 wherein said connector means comprise sprockets on each of said shafts, a chain means wrapping said sprockets in a figure eight configuration and said releasable means interconnecting opposite ends of said chain to complete said figure eight configuration.

3. A packaging machine as defined in claim 1 wherein said means mounting said mounting plate comprises hinge means pivotably mounting said mounting plate on said frame for movement on an axis substantially perpendicular to said longitudinal axis, said guide means also forming handles for moving said mounting plate between said locked and released positions when said guide means are moved into a guiding position and an adjustment position respectively.

4. A packaging machine as defined in claim 2 wherein said means mounting said mounting plate comprises hinge means pivotably mounting said mounting plate on said frame for movement on an axis substantially perpendicular to said longitudinal axis, said guide means also forming handles for moving said mounting plate between said locking and releasing positions when said guide means are moved into a guiding position and an adjustment position respectively.

5. A packaging machine as defined in claim 1 wherein said means mounting said mounting plate on said frame comprises means defining a pivotal axis substantially perpendicular to said rotational axes and said centerline of said path of travel.

6. A packaging machine as defined in claim 1 wherein said means mounting said mounting plate on said frame comprises means defining a pivotal axis substantially perpendicular to said rotational axes and said centerline of said path of travel.

* * * * *